US012624832B2

(12) United States Patent
Tang et al.

(10) Patent No.: US 12,624,832 B2
(45) Date of Patent: May 12, 2026

(54) HYBRID FEEDING DEVICE FOR AUTOMATICALLY ADJUSTING CO-FIRING AMOUNT OF DECAYING GARBAGE

(71) Applicant: SOUTH CHINA UNIVERSITY OF TECHNOLOGY, Guangzhou (CN)

(72) Inventors: Yuting Tang, Guangzhou (CN); Yuxuan Zhang, Guangzhou (CN); Xiaoqian Ma, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 562 days.

(21) Appl. No.: 18/031,867

(22) PCT Filed: Oct. 11, 2021

(86) PCT No.: PCT/CN2021/122966
§ 371 (c)(1),
(2) Date: Apr. 13, 2023

(87) PCT Pub. No.: WO2022/156270
PCT Pub. Date: Jul. 28, 2022

(65) Prior Publication Data

US 2023/0383947 A1 Nov. 30, 2023

(30) Foreign Application Priority Data

Jan. 25, 2021 (CN) ..... 202110096988.6

(51) Int. Cl.
*F23G 5/50* (2006.01)
*F23G 5/00* (2006.01)
(Continued)

(52) U.S. Cl.
CPC ..... *F23G 5/50* (2013.01); *F23G 5/008* (2013.01); *F23G 5/033* (2013.01); *F23G 5/444* (2013.01);
(Continued)

(58) Field of Classification Search
CPC .... F23G 5/442; F23G 5/444; F23G 2205/122; F23G 5/50; F23G 5/008; F23G 5/033;
(Continued)

(56) References Cited

U.S. PATENT DOCUMENTS 6,139,744 A * 10/2000 Spears ..... A47K 11/023 210/201
2004/0049094 A1* 3/2004 Jeanvoine ..... F23G 7/10 405/129.27
(Continued)

FOREIGN PATENT DOCUMENTS

CN 106765134 5/2017
CN 107255285 10/2017
(Continued)

OTHER PUBLICATIONS

"International Search Report (Form PCT/ISA/210) of PCT/CN2021/122966", mailed on Jan. 14, 2022, with English translation thereof, pp. 1-4.

*Primary Examiner* — David J Laux
(74) *Attorney, Agent, or Firm* — JCIPRNET

(57) ABSTRACT

A hybrid feeding device for automatically adjusting a co-firing amount of decaying garbage. The device comprises a mechanical grate furnace, a hybrid garbage conveying device, a raw garbage feeding device, a decaying garbage feeding device, a hybrid garbage crushing device, and a control center. The raw garbage feeding device, the decaying garbage feeding device, and the hybrid garbage conveying device are all connected to the control center. The decaying garbage feeding device is used for transporting decaying garbage to the raw garbage feeding device. The raw garbage feeding device is positioned between the decaying garbage feeding device and the hybrid garbage conveying device. The hybrid garbage crushing device is used for crushing garbage and inputting the garbage to the mechanical grate
(Continued)

furnace. The mechanical grate furnace is internally provided with a plurality of temperature sensors, and the plurality of temperature sensors are connected to the control center.

9 Claims, 1 Drawing Sheet

(51) Int. Cl.
*F23G 5/033* (2006.01)
*F23G 5/44* (2006.01)

(52) U.S. Cl.
CPC .. *F23G 2201/702* (2013.01); *F23G 2205/122* (2013.01); *F23G 2207/101* (2013.01)

(58) Field of Classification Search
CPC ..... F23G 2201/702; F23G 2207/101; F23G 2207/20; F23G 5/44
See application file for complete search history.

(56) References Cited

U.S. PATENT DOCUMENTS

| | | | | |
|---|---|---|---|---|
| 2007/0117195 | A1* | 5/2007 | Warner | C12P 5/023 435/167 |
| 2010/0115961 | A1* | 5/2010 | Chapman | F23G 5/085 202/99 |
| 2011/0271883 | A1* | 11/2011 | Chapman | C10B 53/00 110/346 |
| 2018/0051877 | A1* | 2/2018 | Liss | F23G 5/12 |

FOREIGN PATENT DOCUMENTS

| | | |
|---|---|---|
| CN | 108087895 | 5/2018 |
| CN | 110131726 | 8/2019 |
| CN | 112728554 | 4/2021 |
| WO | 9843018 | 10/1998 |

* cited by examiner

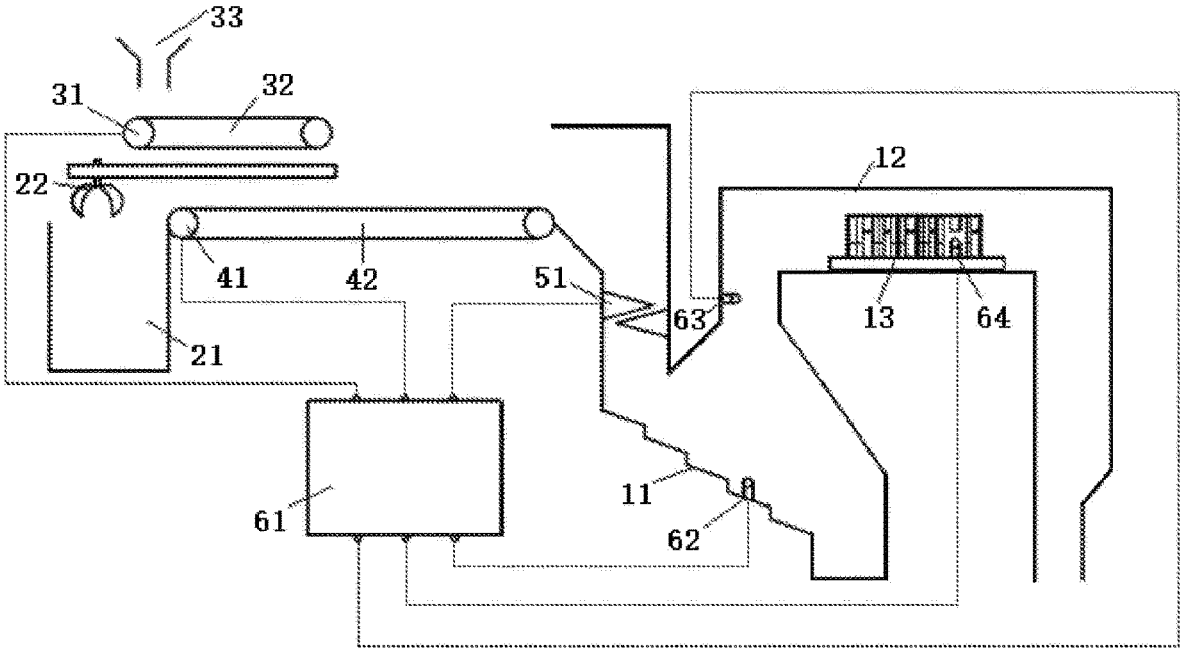
33
31
32
22
41
42
51
63
12
13
64
21
61
11
62

HYBRID FEEDING DEVICE FOR AUTOMATICALLY ADJUSTING CO-FIRING AMOUNT OF DECAYING GARBAGE

CROSS-REFERENCE TO RELATED APPLICATION

This application is a 371 application of the international PCT application serial no. PCT/CN2021/122966, filed on Oct. 11, 2021, which claims the priority benefit of China application no. 202110096988.6, filed on Jan. 25, 2021. The entirety of each of the above-mentioned patent applications is hereby incorporated by reference herein and made a part of this specification.

TECHNICAL FIELD

The present invention relates to the technical field of solid waste incineration devices, in particular to a hybrid feeding device for automatically adjusting a co-firing amount of decaying garbage.

RELATED ART

As the capacity of many landfills will be exhausted, the landfills will successively be closed for renovation, and many cities will be in a "garbage-surrounding-city" dilemma. The reduction of decaying garbage has become an urgent problem in the development of municipal solid garbage landfill treatment. Energizing the combustible components of the decaying garbage is an ideal solution to this problem. That is, it is expected to become one of the technical routes for the popularization and application of large-scale industry in China to take advantage of the existing treatment capacity of raw garbage incinerators and make corresponding improvements to realize the reduction, harmless and resource reuse treatment of raw/decaying garbage.

The source of raw garbage is complex, and its heat value is unstable, which is affected by the factor such as season, climate, and source and so on. After a long-term mineralization process, all kinds of components in garbage reside, accumulate, and transform after landfill, so the components and heat value of the decaying garbage are different from those of the raw garbage, and are affected by the year and mode of landfill. If a co-firing ratio of the raw garbage and the decaying garbage is set only according to the design conditions or operation experience of a raw garbage incinerator, it is easy to cause a mismatch between the co-firing ratio of the decaying garbage and the design conditions of the incinerator. Especially when the proportion of domestic garbage is too low, too high heat value will make the fuel burn out in advance, and the exposure of the grate will bring serious high-temperature corrosion to the furnace, which poses a great threat to apparatus safety. Further, if the fuel is mixed unevenly during the co-firing process, the temperature distribution in the furnace will deviate from the design conditions, which will adversely affect the incinerator efficiency.

In conclusion, the unreasonable co-combustion proportion and mixing mode will threaten the safe operation of an incinerator and adversely affect the power generation efficiency of a garbage incineration power plant. Therefore, it is necessary to develop a device that can automatically adjust the mixing ratio of the raw garbage and the decaying garbage under the co-combustion condition.

SUMMARY OF INVENTION

Technical Problem

Solution to the Problem

Technical Solution

An object of the present invention is to overcome the disadvantages and shortcomings of the prior art, and provide a hybrid feeding device for automatically adjusting a co-firing amount of decaying garbage to solve the problem of combustion instability which may occur due to an unreasonable setting of a feed ratio when the decaying garbage is co-fired in the grate of a garbage incinerator, and can rationally determine a blending ratio of the raw/decaying garbage and ensure the sufficient blending of the two fuels according to actual combustion conditions. While achieving safe and stable operation of an apparatus, the unit treatment capacity of the decaying garbage is increased as much as possible.

The present invention is realized by at least one of the following technical solutions.

A hybrid feeding device for automatically adjusting a co-firing amount of decaying garbage, comprising a hybrid garbage conveying device positioned above a feed port of a mechanical grate furnace, wherein the hybrid feeding device for automatically adjusting the co-firing amount of decaying garbage further comprises a raw garbage feeding device, a decaying garbage feeding device, a hybrid garbage crushing device and a control center; wherein the raw garbage feeding device, the decaying garbage feeding device, the hybrid garbage conveying device and the hybrid garbage crushing device are all connected to the control center;

the decaying garbage feeding device is positioned above the hybrid garbage conveying device, and is used for conveying the decaying garbage to the hybrid garbage conveying device;

the raw garbage feeding device is positioned between the decaying garbage feeding device and the hybrid garbage conveying device, and is used for placing the raw garbage on the hybrid garbage conveying device;

the hybrid garbage crushing device is positioned at an end of the hybrid garbage conveying device and is used for chopping and uniformly mixing the decaying garbage and the raw garbage on the hybrid garbage conveying device, and the chopped and mixed garbage is input to the mechanical grate furnace;

a plurality of temperature sensors are provided in the mechanical grate furnace, the plurality of temperature sensors are connected to the control center, and the plurality of temperature sensors collect working parameters of each part of the mechanical grate furnace and convert the working parameters into corresponding signals and transmit the corresponding signals back to the control center, and transmit feedback signals to the raw garbage feeding device, the decaying garbage feeding device and the hybrid garbage conveying device through processing of the control center, and adjust an operating frequency of each device to realize the control and adjustment of a co-firing ratio.

Preferably, the raw garbage feeding device comprises a raw garbage tank and a garbage grab positioned above the raw garbage tank; the garbage grab takes the raw garbage from the raw garbage tank and places the raw garbage directly on the hybrid garbage conveying device.

Preferably, the decaying garbage feeding device comprises a first variable frequency motor, a first conveyor belt and a decaying garbage tank; the first conveyor belt is positioned below the decaying garbage tank, the decaying garbage falls from an end of the first conveyor belt and then covers the raw garbage on the hybrid garbage conveying device, the first variable frequency motor is connected to the first conveyor belt, and the first variable frequency motor controls movement of the first conveyor belt according to a signal received from the control center.

Preferably, the hybrid garbage conveying device comprises a second variable frequency motor and a second conveyor belt positioned below the garbage grab and the first conveyor belt; the second variable frequency motor is connected to the control center, and controls movement of the second conveyor belt according to a signal received from the control center; an end of the second conveyor belt is positioned above the hybrid garbage crushing device; on the second conveyor belt, the decaying garbage and the raw garbage are fed to the hybrid garbage crushing device via the second conveyor belt.

Preferably, the hybrid garbage crushing device comprises several sets of rotating cutters and a third variable frequency motor controlling the rotating cutters, the several sets of rotating cutters is positioned at an end of the conveyor belt; the third variable frequency motor controls the rotation speed of the several sets of rotating cutter according to the signal of the control center.

Preferably, the several sets of rotating cutters includes parallel rotating cutters and toothed rotating cutters.

Preferably, the mechanical grate furnace comprises a slag discharge port, a grate, a front arch, a flue, a rear arch, and a superheater, wherein the rear arch is positioned at a rear of a furnace chamber, and the front arch is respectively connected to the rear arch via the flue; the superheater is arranged in a flue, and the grate is connected to a slag discharge port.

Preferably, the plurality of temperature sensors are arranged on the grate at the back of in the mechanical grate furnace, on the flue at the back of in the mechanical grate furnace and in the superheater at the back of in the mechanical grate furnace, respectively.

Preferably, the control center comprises an AT89S51 single-chip microcomputer, wherein the AT89S51 single-chip microcomputer controls a rotation speed of a corresponding variable frequency motor according to temperature information collected by the temperature sensors arranged at each position.

Beneficial Effects of the Present Invention

Beneficial Effects

The present invention has the following advantages and beneficial effects compared to the prior art:

(1) the present invention aims to automatically adjust the co-firing ratio of the decaying garbage and improve the adaptability of the garbage incinerator to mixed fuels. When the garbage whose heat value is higher than the designed heat value enters the furnace, the temperature of the grate will increase. The temperature sensor will detect the corresponding change and output the corresponding signal. By reducing the speed of the variable frequency motor, reducing the feeding speed of the decaying garbage, and reducing the average heat value of the mixed fuel entering the furnace, the temperature of the furnace will decrease, avoiding the mechanical grate exposed to high-temperature radiation and high-temperature corrosion when the garbage is combusted prematurely. At the same time, the blending ratio of the decaying garbage should be increased as far as possible if the operating conditions of the grate furnace permit. It not only ensures a higher treatment efficiency of the decaying garbage, but also ensures the safe and stable operation of the unit, and extends the life of the mechanical grate.

(2) Since the mixed combusted fuel is composed of two garbage components with different heat values, the garbage crushing and stirring device introduced can mix the two components uniformly. Thus, unstable and uneven combustion is avoided and stable combustion of fuel is ensured.

(3) The temperature sensor can detect the flue gas temperature in the furnace and the operating conditions of the superheater in real time, appropriately increase or decrease the speed of the variable frequency motor to make the feeding rate be matched with the incinerator design condition. At the same time, the high incinerator efficiency is ensured, the severe high temperature corrosion is prevented, the safe and stable operation of a unit is ensured, and the service life of a mechanical apparatus is extended.

In view of the above, the technology of the present invention is simple and easy to operate, has high combustion efficiency, good adjustability, and low cost, and can be widely used in the field of combined treatment of municipal solid garbage and decaying garbage, with a wide application prospect.

BRIEF DESCRIPTION OF DRAWINGS

Description of Drawings

The FIG. is a schematic view showing the structure of a hybrid feeding device for automatically adjusting a co-firing amount of decaying garbage according to the embodiment;

EMBODIMENTS OF THE INVENTION

Description of Embodiments

In the following description, only preferred embodiments of the present invention are described. All changes which come within the meaning and range of equivalence of the claims and their equivalents are to be embraced within their scope. It will be appreciated by a person skilled in the art that all or a portion of the procedures for carrying out the embodiments described below, and equivalent variations to those described in the claims, may be practiced otherwise than as specifically described without departing from the spirit of the present invention.

As shown in the FIGURE, the embodiment provides a hybrid feeding device for automatically adjusting a co-firing amount of decaying garbage, comprising a mechanical grate furnace, a raw garbage feeding device, a decaying garbage feeding device, a hybrid garbage conveying device, a hybrid garbage crushing device, and a control center 61.

The mechanical grate furnace comprises a slag discharge port, a grate 11, a front arch, a flue 12, a rear arch, and a superheater 13 arranged in the flue 12. The flue 12 is positioned at an upper part of the mechanical grate furnace. The flue 12 has a flue outlet, and the flue inlet is provided with a second temperature sensor 63. The furnace chamber is positioned at the center of the mechanical grate furnace. The rear arch is positioned at the rear part of the furnace chamber, and the front arch and the rear arch are respectively connected to the flue 12. The slag discharge port and the grate 11 are positioned at a lower part of the furnace chamber, and the grate 11 is connected to the slag discharge port. A first temperature sensor 62 is provided on the grate at the back of the mechanical grate furnace, a third temperature sensor 64 is provided in the superheater 13, and each temperature sensor is connected to the control center 61.

Each temperature sensor collects the working parameters of each part of the grate furnace every other time period for monitoring the working condition of the grate furnace, and converts the working parameters into corresponding signals and transmits the corresponding signals back to the control center 61. The corresponding signals form corresponding decision signals in the control center 61. The corresponding decision signals are transmitted to the feeding device and the conveying device, and so as feed back and adjust the combustion condition in the furnace. The length of the monitoring period can then be adjusted on its own as actually required.

Specifically, the control center 61 comprises a main control part based on an AT89S51 single-chip microcomputer, a motor driving part, a connection part with a power supply and a variable frequency motor part, and a DS18220 temperature sensor can be used at a measurement point. According to the temperature information collected by a DS18220 temperature sensor arranged in each position, an AT89S51 single-chip microcomputer controls the rotation speed of the corresponding variable frequency motor. When the temperature of grate at the back of the mechanical grate furnace is normal (800° C.-900° C.), the rotation speed of the first variable frequency motor 31 will maintain a normal level; when the temperature of the grate at the back of the mechanical grate furnace is high (>900° C.), the rotation speed of the first variable frequency motor 31 will slow down; when the temperature of the grate at the back of the mechanical grate furnace exceeds the design temperature of the garbage grate (>950° C.), the first variable frequency motor 31 will stop.

The raw garbage feeding device comprises a raw garbage tank 21 and a garbage grab 22 positioned above the raw garbage tank 21; the garbage grab 22 takes raw garbage from the raw garbage tank 21 and places the raw garbage directly on the hybrid garbage conveying device. The working staff will determine the feeding amount of raw garbage placed on the hybrid garbage conveying device according to the operating gear of the hybrid garbage conveying device, i.e., the frequency of operating the garbage grab can be determined by listing the control rule tables for different gears of the hybrid garbage conveying device.

The decaying garbage feeding device comprises a first variable frequency motor 31, a first conveyor belt 32 and an decaying garbage tank 33; the first conveyor belt 32 is positioned below the decaying garbage tank 33, the decaying garbage falls from an end of the first conveyor belt 32 and then covers on the raw garbage on the hybrid garbage conveying device; the first variable frequency motor 31 is connected to the first conveyor belt 32; and the rotation speed of the first variable frequency motor 31 is controlled by monitoring data of a first temperature sensor 62 distributed on a grate behind the control center 61 and a preprogrammed program in a single-chip microcomputer. By controlling the feeding speed of the decaying garbage in this manner, the blending quality of the decaying garbage per unit time is linearly correlated to the rotation speed of the first variable frequency motor 31, and the higher the rotation speed of the first variable frequency motor 3 is, the greater the blending quality of the decaying garbage will be, and vice versa.

The hybrid garbage conveying device comprises a second variable frequency motor 41 and a second conveyor belt 42 positioned below the garbage grab 22 and the first conveyor belt 32; the second variable frequency motor 41 is connected to the control center 61. The end of the second conveyor belt 42 is positioned above the hybrid garbage crushing device. On the second conveyor belt 42, the raw garbage is in a lower layer and the decaying garbage is in an upper layer, and the decaying garbage and the raw garbage are input to a hybrid garbage crushing device E via the second conveyor belt 42. The mixture of the decaying garbage and the raw garbage can be initially mixed on a hybrid garbage conveying device. The control signal sent by the control center 61 to the second variable frequency motor 41 is determined by the data monitored by the temperature sensors (63, 64) arranged in the flue and the superheater, i.e. constituting a fuzzy control system, wherein the fuzzy control system takes the temperature of the flue gas at the flue inlet and the temperature of the steam generated in the superheater as two control input parameters; the rotation speeds of the first variable frequency motor 31 and the second variable frequency motor 41 are two control outputs, and a control signal is output every time when a user-defined monitoring time period elapses, so that the second variable frequency motor 41 is determined to be in a working gear and the total amount of feeding is adjusted. Specifically, the fuzzy control system needs to control the flue gas temperature to be below 320° C., and to control the high-temperature corrosion caused by the high-temperature acid exhaust gas on the incinerator heating surface of the waste heat recovery section at a low level; at the same time, the steam temperature is controlled in the sub-middle or low temperature range (3.5/2.5 MPa, 400/280° C. or so), to avoid the rapid high-temperature corrosion on the pipe wall, and to avoid affecting the reliability, safety and economy of the whole field operation. This determined operating gear will also be communicated back to the raw garbage feeding device as a reference for the working staff to control the feeding amount of raw garbage.

The hybrid garbage crushing device comprises a third variable frequency motor 51 and several sets of rotating cutters, wherein the several sets of rotating cutters comprises a parallel rotating cutter and a 24-teeth rotating cutter. The hybrid garbage crushing device is in front of the feed port of the incinerator, and the several sets of rotating cutters are driven to be rotated by the third variable frequency motor 51. Through the crushing process of the hybrid garbage crushing device, the decaying garbage and the raw garbage can be effectively and compulsorily mixed uniformly, and the particle size of the feed can be controlled to a certain extent to ensure the uniformity of the feed. The third variable frequency motor 51 will also be controlled by the fuzzy control system, and the rotation speed of the crushing cutter is determined according to the temperature of the flue gas at the flue inlet and the temperature of the steam generated in the superheater, and the decaying garbage and the raw garbage are further mixed thoroughly to ensure stable combustion on the grate 11.

The present invention controls the particle size of the feeding garbage within a certain range by means of a hybrid garbage crushing device, and compulsorily and effectively mixes two kinds of garbage fuels by means of the movement of the crushing device to avoid an unstable combustion situation caused by uneven mixing of materials. At the same time, the blending ratio of the decaying garbage and the total feeding amount of the raw garbage and the decaying garbage can be automatically adjusted, and the user can set the corresponding working gears of the grate at the back of the mechanical grate furnace, the flue inlet, the main steam sensor, and the variable frequency motor according to the specific design conditions. By rationally setting the total feeding amount in the present invention, it is possible to improve the matching degree of the overall actual operating conditions with the design conditions of the raw garbage incinerator and the waste heat incinerator, respectively. The technology of the present invention is simple and easy to operate, has high combustion efficiency, good adjustability, and low cost, and can be widely used in the field of combined treatment of municipal solid garbage and decaying garbage, with a wide application prospect.

In order that a person skilled in the art may better understand the present invention, the following detailed description of the present invention is made with reference to the accompanying drawings and detailed description. It is to be understood that the described embodiments are merely part of, but not all, the present invention. Based on the embodiments of the present invention, all other embodiments obtained by a person of ordinary skill in the art without inventive effort fall within the scope of the present invention.

What is claimed is:

1. A hybrid feeding device for automatically adjusting a co-firing amount of decaying garbage, comprising a hybrid garbage conveying device positioned above a feed port of a mechanical grate furnace, the hybrid feeding device for automatically adjusting the co-firing amount of decaying garbage further comprises a raw garbage feeding device, a decaying garbage feeding device, a hybrid garbage crushing device and a control center;

wherein the raw garbage feeding device, the decaying garbage feeding device, the hybrid garbage conveying device and the hybrid garbage crushing device are all connected to the control center;

the decaying garbage feeding device is positioned above the hybrid garbage conveying device, and is used for conveying the decaying garbage to the hybrid garbage conveying device;

the raw garbage feeding device is positioned between the decaying garbage feeding device and the hybrid garbage conveying device, and is used for placing the raw garbage on the hybrid garbage conveying device;

the hybrid garbage crushing device is positioned at an end of the hybrid garbage conveying device and is used for chopping and uniformly mixing the decaying garbage and the raw garbage on the hybrid garbage conveying device, and the chopped and mixed garbage is input to the mechanical grate furnace;

a plurality of temperature sensors are provided in the mechanical grate furnace, the plurality of temperature sensors are connected to the control center, and the plurality of temperature sensors collect working parameters of each part of the mechanical grate furnace and convert the working parameters into corresponding signals and transmit the corresponding signals back to the control center;

wherein the control center transmits feedback signals to the raw garbage feeding device, the decaying garbage feeding device and the hybrid garbage conveying device, and adjusts an operating frequency of each device to realize the control and adjustment of a co-firing ratio.

2. The hybrid feeding device for automatically adjusting the co-firing amount of decaying garbage according to claim 1, the raw garbage feeding device comprises a raw garbage tank and a garbage grab positioned above the raw garbage tank; the garbage grab takes the raw garbage from the raw garbage tank and places the raw garbage directly on the hybrid garbage conveying device.

3. The hybrid feeding device for automatically adjusting the co-firing amount of decaying garbage according to claim 1, the decaying garbage feeding device comprises a first variable frequency motor, a first conveyor belt and a decaying garbage tank; the first conveyor belt is positioned below the decaying garbage tank, the decaying garbage falls from an end of the first conveyor belt and then covers on the raw garbage on the hybrid garbage conveying device, the first variable frequency motor is connected to the first conveyor belt, and the first variable frequency motor controls movement of the first conveyor belt according to a signal received from the control center.

4. The hybrid feeding device for automatically adjusting the co-firing amount of decaying garbage according to claim 1, the hybrid garbage conveying device comprises a second variable frequency motor and a second conveyor belt positioned below the garbage grab and the first conveyor belt; the second variable frequency motor is connected to the control center, and controls movement of the second conveyor belt according to a signal received from the control center; an end of the second conveyor belt is positioned above the hybrid garbage crushing device; on the second conveyor belt, the decaying garbage and the raw garbage are fed to the hybrid garbage crushing device via the second conveyor belt.

5. The hybrid feeding device for automatically adjusting the co-firing amount of decaying garbage according to claim 4, the hybrid garbage crushing device comprises several sets of rotating cutters and a third variable frequency motor controlling the rotating cutters, the several sets of rotating cutters is positioned at an end of the second conveyor belt; the third variable frequency motor controls the rotation speed of the several sets of rotating cutters according to the signal of the control center.

6. The hybrid feeding device for automatically adjusting the co-firing amount of decaying garbage according to claim 1, the several sets of rotating cutters comprises parallel rotating cutters and toothed rotating cutters.

7. The hybrid feeding device for automatically adjusting the co-firing amount of decaying garbage according to claim 1, the mechanical grate furnace comprises a slag discharge port, a grate, a front arch, a flue, a rear arch and a superheater, wherein the rear arch is positioned at a rear of a furnace chamber, and the front arch is respectively connected to the rear arch via the flue; the superheater is arranged in the flue, and the grate is connected to the slag discharge port.

8. The hybrid feeding device for automatically adjusting the co-firing amount of decaying garbage according to claim 1, the plurality of temperature sensors are arranged on the grate at the back of the mechanical grate furnace, on the flue at the back of the mechanical grate furnace, and in the superheater at the back of the mechanical grate furnace, respectively.

9. The hybrid feeding device for automatically adjusting the co-firing amount of decaying garbage according to claim 1, the control center comprises an AT89S51 single-chip microcomputer, wherein the AT89S51 single-chip microcomputer controls a rotation speed of a corresponding variable frequency motor according to temperature information collected by the temperature sensors arranged at each position.

* * * * *